US012326055B2

(12) United States Patent
Sheiretov et al.

(10) Patent No.: US 12,326,055 B2
(45) Date of Patent: Jun. 10, 2025

(54) METHODS AND APPARATUS FOR REMOVING SECTIONS OF A WELLBORE WALL

(71) Applicant: Schlumberger Technology Corporation, Sugar Land, TX (US)

(72) Inventors: Todor Sheiretov, Houston, TX (US); Matthew Dresel, Princeton Junction, NJ (US); Nathan Landsiedel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/653,091

(22) Filed: May 2, 2024

(65) Prior Publication Data

US 2024/0271500 A1 Aug. 15, 2024

Related U.S. Application Data

(63) Continuation of application No. 17/253,642, filed as application No. PCT/US2019/039682 on Jun. 28, 2019, now abandoned.

(Continued)

(51) Int. Cl.

| | |
|---|---|
| ***E21B 29/00*** | (2006.01) |
| ***E21B 10/26*** | (2006.01) |
| ***E21B 23/01*** | (2006.01) |

(52) U.S. Cl.

CPC ..... *E21B 29/005* (2013.01); *E21B 10/26* (2013.01); *E21B 23/01* (2013.01)

(58) Field of Classification Search

CPC ..... E21B 23/01; E21B 10/26; E21B 29/005

See application file for complete search history.

(56) References Cited

U.S. PATENT DOCUMENTS

| | | | |
|---|---|---|---|
| 1,867,289 | A | 7/1932 | Ercole |
| 2,481,637 | A | 9/1949 | Yancey |

(Continued)

FOREIGN PATENT DOCUMENTS

| | | | |
|---|---|---|---|
| CN | 105269047 | A | 1/2016 |
| EP | 1076758 | A2 | 2/2001 |

(Continued)

OTHER PUBLICATIONS

International Search Report and Written Opinion of International Patent Application No. PCT/US2019/039682 dated Oct. 24, 2019, 14 pages.

(Continued)

*Primary Examiner* — D. Andrews
*Assistant Examiner* — Ronald R Runyan
(74) *Attorney, Agent, or Firm* — Jeffrey D. Frantz

(57) ABSTRACT

A downhole tool may include an anchor coupled to a first portion of the downhole tool and configured to engage with a feature of a wellbore to affix the first portion to the feature. The downhole tool may also include a linear actuator coupled to the first portion and to a second portion of the downhole tool, where the linear actuator is configured to move the second portion relative to the first portion and the feature. The downhole tool may further include a cutting head coupled to the second portion and including one or more cutters configured to engage with the feature. The downhole tool may also include a control system configured to obtain remote commands to control the anchor, the linear actuator, the cutting head, or a combination thereof.

18 Claims, 7 Drawing Sheets

Related U.S. Application Data

(60) Provisional application No. 62/867,637, filed on Jun. 27, 2019, provisional application No. 62/690,985, filed on Jun. 28, 2018.

(56) References Cited

U.S. PATENT DOCUMENTS

| | | | | |
|---|---|---|---|---|
| 2,735,485 | A | 2/1956 | Metcalf, Jr. | |
| 2,899,000 | A | 8/1959 | Medders | |
| 3,248,253 | A | 4/1966 | Barford | |
| 3,802,974 | A | 4/1974 | Emmel | |
| 4,044,863 | A * | 8/1977 | Feldman | B63B 21/04 188/65.1 |
| 4,515,212 | A * | 5/1985 | Krugh | E21B 27/00 166/99 |
| 4,565,252 | A | 1/1986 | Campbell | |
| 4,651,823 | A * | 3/1987 | Spikes | E21B 17/1028 166/241.7 |
| 4,889,197 | A | 12/1989 | Boe | |
| 4,957,612 | A | 9/1990 | Stewart | |
| 5,035,293 | A | 7/1991 | Rives | |
| 5,036,921 | A | 8/1991 | Pittard | |
| 5,060,738 | A | 10/1991 | Pittard | |
| 5,074,355 | A | 12/1991 | Lennon | |
| 5,210,377 | A | 5/1993 | Kennedy | |
| 5,392,858 | A | 2/1995 | Peters | |
| 5,447,207 | A | 9/1995 | Jones | |
| 5,582,260 | A | 12/1996 | Murer | |
| 5,810,100 | A | 9/1998 | Samford | |
| 5,899,268 | A | 5/1999 | Lynde | |
| 6,009,961 | A | 1/2000 | Pietrobelli | |
| 6,125,929 | A | 10/2000 | Davis | |
| 6,202,752 | B1 | 3/2001 | Kuck | |
| 6,357,528 | B1 | 3/2002 | Davis | |
| 6,401,821 | B1 | 6/2002 | Kennedy | |
| 6,679,328 | B2 | 1/2004 | Davis | |
| 6,868,901 | B2 | 3/2005 | Mason | |
| 6,920,923 | B1 | 7/2005 | Pietrobelli | |
| 7,143,848 | B2 | 12/2006 | Armell | |
| 7,314,099 | B2 | 1/2008 | Dewey | |
| 7,326,854 | B2 | 2/2008 | Varkey | |
| 7,462,781 | B2 | 12/2008 | Varkey | |
| 7,540,327 | B2 | 6/2009 | Billingham | |
| 7,793,409 | B2 | 9/2010 | Varkey | |
| 7,909,100 | B2 | 3/2011 | Bryant, Jr. | |
| 7,934,311 | B2 | 5/2011 | Varkey | |
| 8,082,988 | B2 | 12/2011 | Redlinger | |
| 8,210,251 | B2 | 7/2012 | Lynde | |
| 8,413,723 | B2 | 4/2013 | Varkey | |
| 8,540,035 | B2 | 9/2013 | Xu | |
| 8,955,597 | B2 | 2/2015 | Connell | |
| 9,097,073 | B2 | 8/2015 | Schmidt | |
| 9,187,971 | B2 | 11/2015 | Hutchinson | |
| 9,353,589 | B2 | 5/2016 | Hekelaar | |
| 9,359,853 | B2 | 6/2016 | Nas | |
| 9,366,101 | B2 | 6/2016 | Colbert | |
| 9,556,696 | B2 | 1/2017 | Donovan | |
| 9,617,815 | B2 | 4/2017 | Schwartze | |
| 9,644,472 | B2 | 5/2017 | Fuhst | |
| 9,725,977 | B2 | 8/2017 | Laird | |
| 2002/0144815 | A1 | 10/2002 | Van Drentham-Susman | |
| 2002/0162659 | A1 | 11/2002 | Davis | |
| 2004/0045659 | A1 | 3/2004 | Kobayashi | |
| 2004/0245020 | A1 | 12/2004 | Giroux | |
| 2005/0039905 | A1 | 2/2005 | Hart | |
| 2006/0231258 | A1 | 10/2006 | Head | |
| 2007/0251687 | A1 | 11/2007 | Martinez | |
| 2008/0115972 | A1 | 5/2008 | Lynde | |
| 2009/0266544 | A1 | 10/2009 | Redlinger | |
| 2009/0308605 | A1 * | 12/2009 | McAfee | E21B 29/005 166/55.7 |
| 2009/0316528 | A1 | 12/2009 | Ramshaw | |
| 2010/0006290 | A1 | 1/2010 | Saylor, III | |
| 2010/0065264 | A1 | 3/2010 | Nackerud | |
| 2011/0042072 | A1 * | 2/2011 | Villegas | E21B 23/14 166/250.01 |
| 2011/0278064 | A1 | 11/2011 | Rasheed | |
| 2012/0152543 | A1 | 6/2012 | Davis | |
| 2012/0305249 | A1 | 12/2012 | Connell | |
| 2012/0325480 | A1 | 12/2012 | Schmidt | |
| 2013/0199785 | A1 | 8/2013 | Hekelaar | |
| 2013/0227837 | A1 | 9/2013 | Varkey | |
| 2013/0233587 | A1 | 9/2013 | Varkey | |
| 2014/0096947 | A1 | 4/2014 | Colbert | |
| 2014/0124202 | A1 | 5/2014 | Beynon | |
| 2014/0231087 | A1 | 8/2014 | Orstad | |
| 2015/0034311 | A1 | 2/2015 | Tunget | |
| 2015/0129195 | A1 | 5/2015 | Laird | |
| 2015/0239795 | A1 | 8/2015 | Doud | |
| 2015/0267493 | A1 | 9/2015 | Schwartze | |
| 2015/0275605 | A1 | 10/2015 | Bennett | |
| 2015/0345222 | A1 * | 12/2015 | Elshafei | E21B 4/02 175/45 |
| 2016/0245032 | A1 | 8/2016 | Hekelaar | |
| 2016/0293298 | A1 | 10/2016 | Varkey | |
| 2016/0319619 | A1 | 11/2016 | Hekelaar | |
| 2016/0348453 | A1 | 12/2016 | Robertson | |
| 2016/0349302 | A1 | 12/2016 | Chevillard | |
| 2017/0051609 | A1 | 2/2017 | Foster | |
| 2018/0128071 | A1 | 5/2018 | Clem | |

FOREIGN PATENT DOCUMENTS

| | | | |
|---|---|---|---|
| EP | 2960428 | A2 | 12/2015 |
| WO | 0235055 | A1 | 5/2002 |
| WO | 03101656 | A1 | 12/2003 |
| WO | 2003101656 | A1 | 12/2003 |
| WO | 2014137315 | A1 | 9/2014 |
| WO | 2014150524 | A2 | 9/2014 |
| WO | 2015054227 | A2 | 4/2015 |
| WO | 2015054227 | A3 | 8/2015 |
| WO | 2015191572 | A1 | 12/2015 |
| WO | 2016011085 | A1 | 1/2016 |
| WO | 2016148682 | A1 | 9/2016 |
| WO | 2016191720 | A1 | 12/2016 |
| WO | 2017039983 | A1 | 3/2017 |
| WO | 2017142417 | A1 | 8/2017 |
| WO | 2019069055 | A1 | 4/2019 |
| WO | 2020006333 | A1 | 1/2020 |

OTHER PUBLICATIONS

International Preliminary Report on Patentability of International Patent Application No. PCT/US2019/039682 dated Jan. 7, 2021, 10 pages.

Extended Search Report issued in European Patent Application No. 19826150.5 dated Jan. 21, 2022, 7 pages.

First Office Action issued in Chinese Patent Application 201980050179.2 dated Oct. 8, 2022, 19 pages.

Exam Report issued in European Patent Application No. 19826150.5 dated Mar. 10, 2023, 5 pages.

Jie, Y. et al., "Flow Measurement in the Borehole", in Well Flow Measurement Technology, Sichuan Science and Technology Press, Dec. 1992, pp. 87-88, with English translation.

Rejection Decision issued in Chinese Patent Application 201980050179.2 dated Mar. 22, 2023, 21 pages with English translation.

Office Action issued in U.S. Appl. No. 17/253,642 dated May 9, 2023, 19 pages.

Office Action issued in U.S. Appl. No. 17/253,642 dated Aug. 30, 2022, 20 pages.

* cited by examiner

METHODS AND APPARATUS FOR REMOVING SECTIONS OF A WELLBORE WALL

CROSS REFERENCE PARAGRAPH

This application is a Continuation of U.S. Non Provisional Ser. No. 17/253,642 entitled "METHODS AND APPARATUS FOR REMOVING SECTIONS OF A WELLBORE WALL," filed Dec. 18, 2020, which is a National Stage Entry of International Application No. PCT/US2019/039683, filed Jun. 28, 2019, which claims the benefit of U.S. Provisional Application No. 62/690,985, entitled "METHODS AND APPARATUS FOR REMOVING SECTIONS OF A WELLBORE WALL," filed Jun. 28, 2018, and U.S. Provisional Application No. 62/867,637, entitled "METHODS AND APPARATUS FOR REMOVING SECTIONS OF A WELLBORE WALL," filed Jun. 27, 2019, the disclosures of which are hereby incorporated herein by reference.

BACKGROUND

This disclosure relates to systems and methods for performing machining operations within a wellbore using downhole tools.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In some cases, it may be desirable to perform machining operations on a casing or other component disposed within a wellbore. For example, it may be desirable to machine a portion of the casing to facilitate plug and abandon operations of the wellbore. Unfortunately, it may be difficult to effectively perform machining operations on the casing due to spatial constraints within the wellbore.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a downhole tool includes an anchor coupled to a first portion of the downhole tool and configured to engage with a feature of a wellbore to affix the first portion to the feature. The downhole tool also includes a linear actuator coupled to the first portion and to a second portion of the downhole tool, where the linear actuator is configured to move the second portion relative to the first portion and the feature. The downhole tool further includes a cutting head coupled to the second portion and including one or more cutters configured to engage with the feature. The downhole tool also includes a control system configured to obtain remote commands to control the anchor, the linear actuator, the cutting head, or a combination thereof.

In another example, a wireline system includes a drum configured to spool or unspool a cable into a wellbore and a downhole tool coupled to the cable. The downhole tool includes a linear actuator coupled to a first portion and to a second portion of the downhole tool, where the linear actuator is configured to move the first portion and the second portion relative to one another. The downhole tool also includes a cutting head coupled to the second portion and including one or more cutters configured to engage with a feature of the wellbore. The downhole tool further includes a data processing system configured to provide instructions to control the linear actuator, the cutting head, or both.

In another example, a method includes disposing a downhole tool within a casing of a wellbore, fastening the downhole to an interior surface of the casing through an anchor, and rotating a cutting head having one or more cutters relative to the casing. The method also includes forcing the one or more cutters into the casing to machine the interior surface of the casing using the one or more cutters.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
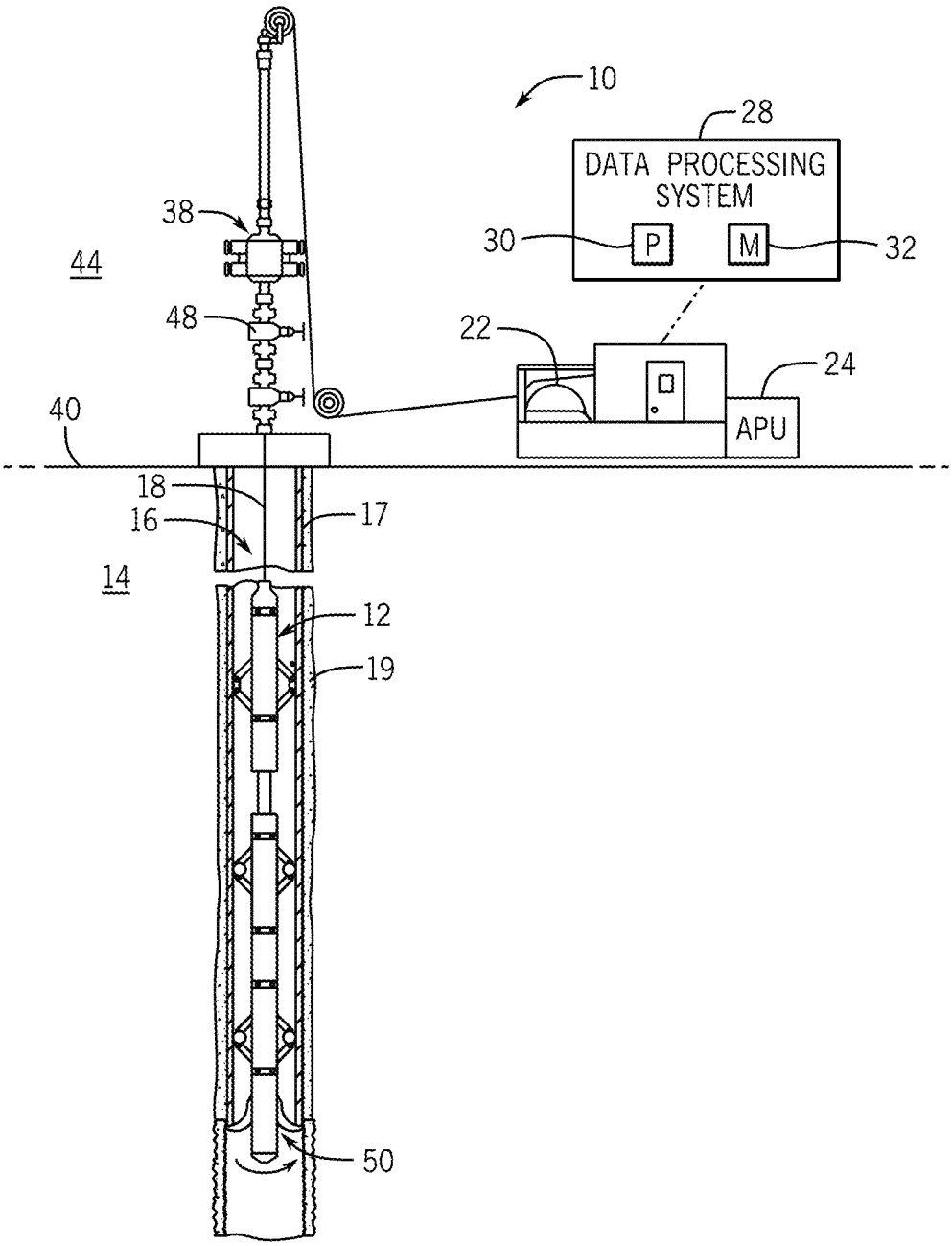
FIG. 1 is a schematic diagram of an embodiment of a wireline system, in accordance with an embodiment of the present disclosure.

With the foregoing in mind, FIG. 1 illustrates a wireline system 10 that may employ the systems and methods of this disclosure. The wireline system 10 may be used to convey a downhole tool 12 through a geological formation 14 via a wellbore 16. In some embodiments, a casing 17 may be disposed within the wellbore 16, such that the downhole tool 12 may traverse the wellbore 16 within the casing 17. As discussed in detail below, a cement lining 19 may be positioned between the casing 17 and the geological formation 14, such that the casing 17 is cemented (e.g., affixed to) the surrounding geological formation 14. For clarity, as used herein, the casing 17 and the cement lining 19 may be referred to as respective "features" of the wellbore 16.

The downhole tool 12 may be conveyed through the wellbore 16 via a cable 18 of the wireline system 10. The wireline system 10 may be substantially fixed (e.g., a long-term installation that is substantially permanent or modular) or may be a mobile wireline system, such as a wireline system carried by a truck. Any suitable cable 18 may be used to convey the downhole tool 12 through the wellbore 16. The cable 18 may be spooled and unspooled on a drum 22 of the wireline system 10. In some embodiments, a power unit 24 may provide energy (e.g., electrical energy) to the wireline system 10 and/or the downhole tool 12.

The wireline system 10 may include a data processing system 28 that may control operations of the wireline system 10 and/or the downhole tool 12 in accordance with techniques discussed herein. Indeed, as discussed in detail below, the data processing system 28 may enable autonomous operation of the downhole tool 12 within the wellbore 16. The data processing system 28 includes a processor 30, which may execute instructions stored in a memory 32. As such, the memory 32 may be any suitable article of manufacture that can store the instructions. The memory 32 and may be ROM memory, random-access memory (RAM), flash memory, an optical storage medium, or a hard disk drive, to name a few examples.

In the illustrated embodiment, the wireline system 10 includes wellbore equipment or pressure control equipment 38 disposed near a surface 40 of the geological formation 14. The pressure control equipment 38 enables the cable 18 to move the downhole tool 12 through the wellbore 16, while substantially blocking pressurized fluid within the wellbore 16 from leaking into an ambient environment 44 (e.g., the atmosphere). In some embodiments, the pressure control equipment 38 includes a pack-off 48 that may form a fluidic seal around the cable 18. For example, the cable 18 may pass through an annular opening within the pack-off 48 that may conform to an external surface of the cable 18, thus forming the fluid seal. Accordingly, the pack-off 48 may mitigate wellbore fluids or other contaminants, such as grease, from entering the wellbore 16 or discharging from the wellbore 16. It should be appreciated that the pressure control equipment 38 may include any other suitable components or combination of components that may facilitate traversing the cable 18 and the downhole tool 12 through the wellbore 16. That is, the pressure control equipment 38 may additionally include, for example, a lubricator, a tool trap, a pump-in-sub, a cable shearing device, one or more motorized rollers, or any other suitable component(s).

As discussed in detail below, in some embodiments, such as during plug and abandonment operations of the wellbore 16, it may be desirable to remove a section of the casing 17 from the wellbore 16. Additionally, it may be desirable to remove a section of the cement lining 19 surrounding the casing 17. Accordingly, embodiments of the downhole tool 12 discussed herein are equipped with a cutting head 50 that is operable to selectively remove one or more sections of the casing 17 and/or one or more sections of the cement lining 19 from the wellbore 16.

Figure 2:
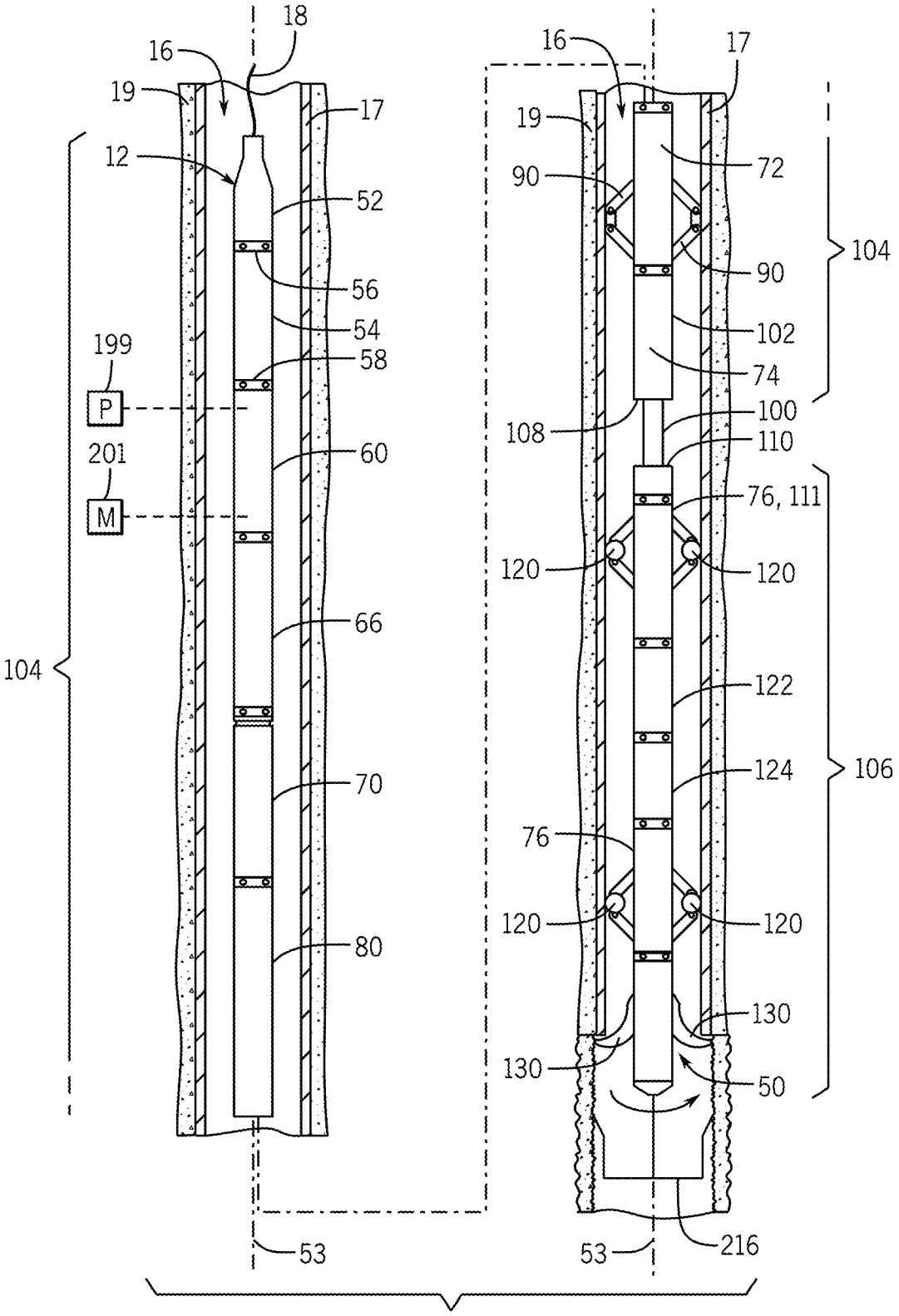
FIG. 2 is a schematic diagram of an embodiment of a downhole tool that may be used in a wireline system, in accordance with an embodiment of the present disclosure.

To better illustrate the downhole tool 12 and to facilitate the following discussion, FIG. 2 is a schematic of an embodiment of the downhole tool 12. In the illustrated embodiment, the downhole tool 12 includes a logging head 52 that couples the downhole tool 12 to the cable 18. In some embodiments, the logging head 52 houses a cable tension sensor and a release device. The release device may be operable to detach the downhole tool 12 from the cable 18. The cable tension sensor and the release device may be communicatively coupled to, for example, the data processing system 28. The downhole tool 12 may include a swivel 54 that is coupled to the logging head 52 at a first end portion 56 of the swivel 54. In some embodiments, the swivel 54 may rotate or swivel relative to the logging head 52 (e.g., about a central axis 53 of the downhole tool 12). Accordingly, the swivel 54 may ensure that components of the downhole tool 12 that are coupled to a second end portion 58 of the swivel 54 may rotate or swivel relative to the logging head 52 without imparting a torque on the cable 18.

In the illustrated embodiment, the downhole tool 12 includes a telemetry module 60, also referred to herein as a control system, which is coupled to the second end portion 58 of the swivel 54. As discussed below, the telemetry module 60 may include sensors that transmit real-time data indicative of one or more operational parameters of the downhole tool 12 to the data processing system 28. Additionally, the telemetry module 60 may enable remote control of the downhole tool 12 via instructions provided by the processor 30 and/or an operator (e.g., a wireline operator) of the wireline system 10. The telemetry module 60 may be coupled to a power electronics module 66. In some embodiments, the power electronics module 66 may include batteries for providing electrical power to one or more components of the downhole tool 12. Additionally or alternatively, the power electronics module 66 may distribute electrical power provided by the power unit 24 (e.g., via the electrical lines embedded in the cable 18) to various sensors, actuators, motors, or other components of the downhole tool 12. In some embodiments, the power electronics module 66 may provide power (e.g., electrical power) that is used to operate one or more hydraulic pumps included in a hydraulic module 70 of the downhole tool 12. As shown in the illustrated embodiment, the hydraulic module 70 may be coupled to the power electronics module 66. The one or more hydraulic pumps of the hydraulic module 70 may be operable to provide a flow of pressurized hydraulic fluid to various actuators and/or motors of the downhole tool 12.

For example, as discussed below, the hydraulic module 70 may provide a flow of pressurized hydraulic fluid to a hydraulic motor of the cutting head 50, such that the hydraulic motor may rotate the cutting head 50 about the central axis 53 of the downhole tool 12 (e.g., relative to the casing 17). The hydraulic module 70 may also provide pressurized hydraulic fluid to an anchor 72, a linear actuator 74, and/or one or more centralizers 76 that may be included in the downhole tool 12.

In the illustrated embodiment, the downhole tool 12 includes a compensator 80 that may serve as a hydraulic fluid reservoir for the hydraulic module 70. Additionally or alternatively, the compensator 80 may operate to provide pressure compensation to various hydraulically actuated components of the downhole tool 12, such as, for example, the anchor 72, the linear actuator 74, and/or the one or more centralizers 76.

In some embodiments, the anchor 72 may include one or more legs 90 that are selectively extendable from the anchor 72 in a direction that extends generally outward (e.g., radially outward) from the central axis 53 of the downhole tool 12. Accordingly, the legs 90 may engage with the casing 17, the cement lining 19, or the geological formation 14. Particularly, in an extended position, the legs 90 may block rotational motion (e.g., about the central axis 53) and/or linear movement (e.g., along the central axis 53) of the anchor 72 relative to the casing 17. The legs 90 may be transitionable between the extended position and a retracted position by regulating a flow of hydraulic fluid supplied to the anchor 72 via the hydraulic module 70. Although the illustrated embodiment of the downhole tool 12 includes a single anchor 72, it should be understood that, in other embodiments, the downhole tool 12 may include a plurality of anchors 72 that are located at various portions of the downhole tool 12, such as near the logging head 52 and/or near the cutting head 50.

The linear actuator 74 includes a piston 100 (e.g., or multiple pistons) that may extend from or retract into a body 102 of the linear actuator 74 (e.g., via regulation of a hydraulic fluid flow to the linear actuator 74). As discussed in detail below, the linear actuator 74 may therefore enable translational movement of an upper body 104 of the downhole tool 12 relative to a lower body 106 of the downhole tool 12. For clarity, the upper body 104 may include components of the downhole tool 12 that are positioned between a lower end 108 of the linear actuator 74 and the logging head 52. The lower body 106 may include components of the downhole tool 12 that are positioned between an upper end 110 of a first centralizer 111 of the centralizers 76 and the cutting head 50. In some embodiments, the piston 100 may be configured to block rotational motion (e.g., about the central axis 53) of the lower body 106 relative to the upper body 104. Moreover, it should be appreciated that, in some embodiments, the piston 100 may house various hydraulic lines and/or electrical lines that may provide hydraulic fluid and/or electrical power to certain components of the lower body 106, such as the centralizers 76. For example, the piston 100 may include a hollow interior region or passage that enables conduits, tubes, wires, or other connection features to extend between components of the upper body 104 and components of the lower body 106.

The one or more centralizers 76 may be transitionable between a retracted position, in which the centralizers 76 do not engage with the casing 17, and an extended position, in which rollers 120 of the centralizer 76 engage (e.g., contact) a surface of the casing 17. In other embodiments, the centralizers 76 may be passive components that are permanently positioned in the extended position. While shown with rollers 120 in the present embodiment, in other embodiments, the centralizers 76 may not include rollers. In any case, the centralizers 76 may align the downhole tool 12 concentrically within the casing 17. The rollers 120 may enable the lower body 106 of the downhole tool 12 to translate axially along the casing 17 while the centralizers 76 are in the extended position. In this manner, the centralizers 76 may facilitate the operation of the downhole tool 12 as discussed below.

In the illustrated embodiment, the downhole tool 12 includes a motor 122 and a gearbox 124 that are coupled to and positioned between the centralizers 76. The motor 122 and the gearbox 124 are cooperatively operable to impart a torque on the cutting head 50 that is sufficient to rotate the cutting head 50 (e.g., about the central axis 53) relative to a remaining portion of the downhole tool 12. In some embodiments, the hydraulic module 70 may supply a flow of pressurized hydraulic fluid to the motor 122 that enables the motor 122 to drive rotation of the cutting head 50. As discussed in detail below, the cutting head 50 may include one or more knives 130 (e.g., cutting tools, cutters) that are selectively extendable between a retracted position, in which the knives 130 do not engage with the casing 17 and/or the cement lining 19, and an extended position, in which the knives 130 engage (e.g., contact) the casing 17, the cement lining 19, or both. Accordingly, in the extended position, the knives 130 may cut into the casing 17 and/or the cement lining 19 when the cutting head 50 rotates about the central axis 53, thereby enabling the knives 130 to remove (e.g., via machining such as cutting, abrasion) a section of the casing 17 and/or the cement lining 19 that is in contact with the knives 130.

Figure 3:
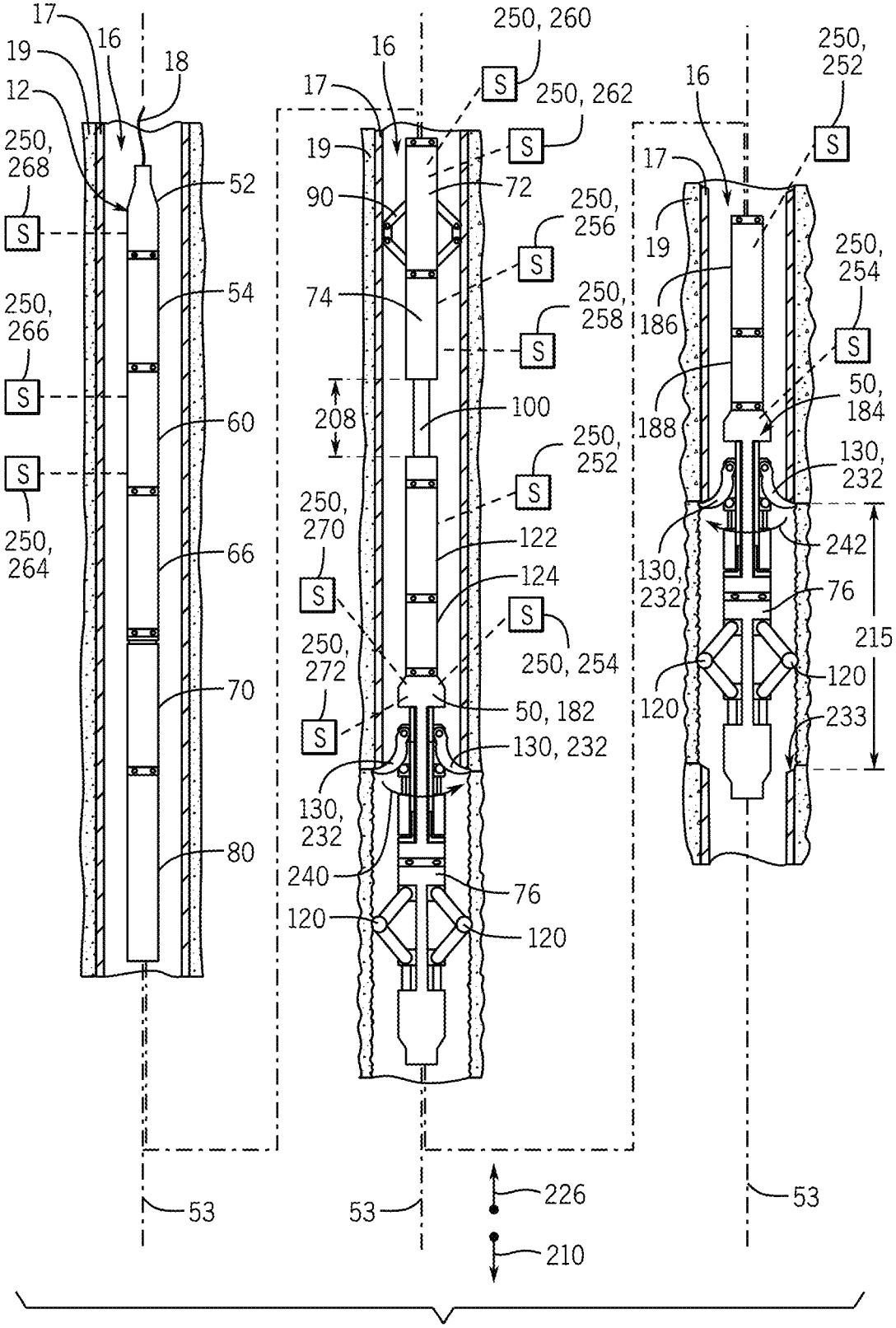
FIG. 3 is a schematic diagram of an embodiment of a downhole tool that may be used in a wireline system, in accordance with an embodiment of the present disclosure.

FIG. 3 is a schematic diagram of another embodiment of the downhole tool 12. In the illustrated embodiment, the downhole tool 12 includes a pair of cutting heads 50 (e.g., a first cutting head 182 and a second cutting head 184) that may be used individually or concurrently to remove sections of the casing 17 and/or the cement lining 19. Indeed, it should be understood that downhole tool 12 may include any suitable quantity of cutting heads 50 that are operable to perform machining operations (e.g., cutting, grinding, drilling) on the casing 17 and/or the cement lining 19. In some embodiments, the cutting heads 50 may be driven by the same motor 122 and the same gearbox 124. In other embodiments, each of the cutting heads 50 may include a dedicated motor and a dedicated gearbox that is configured to drive rotation that particular cutting head. For example, the second cutting head 184 may be driven by an additional motor 186 and an additional gearbox 188.

Figure 4:
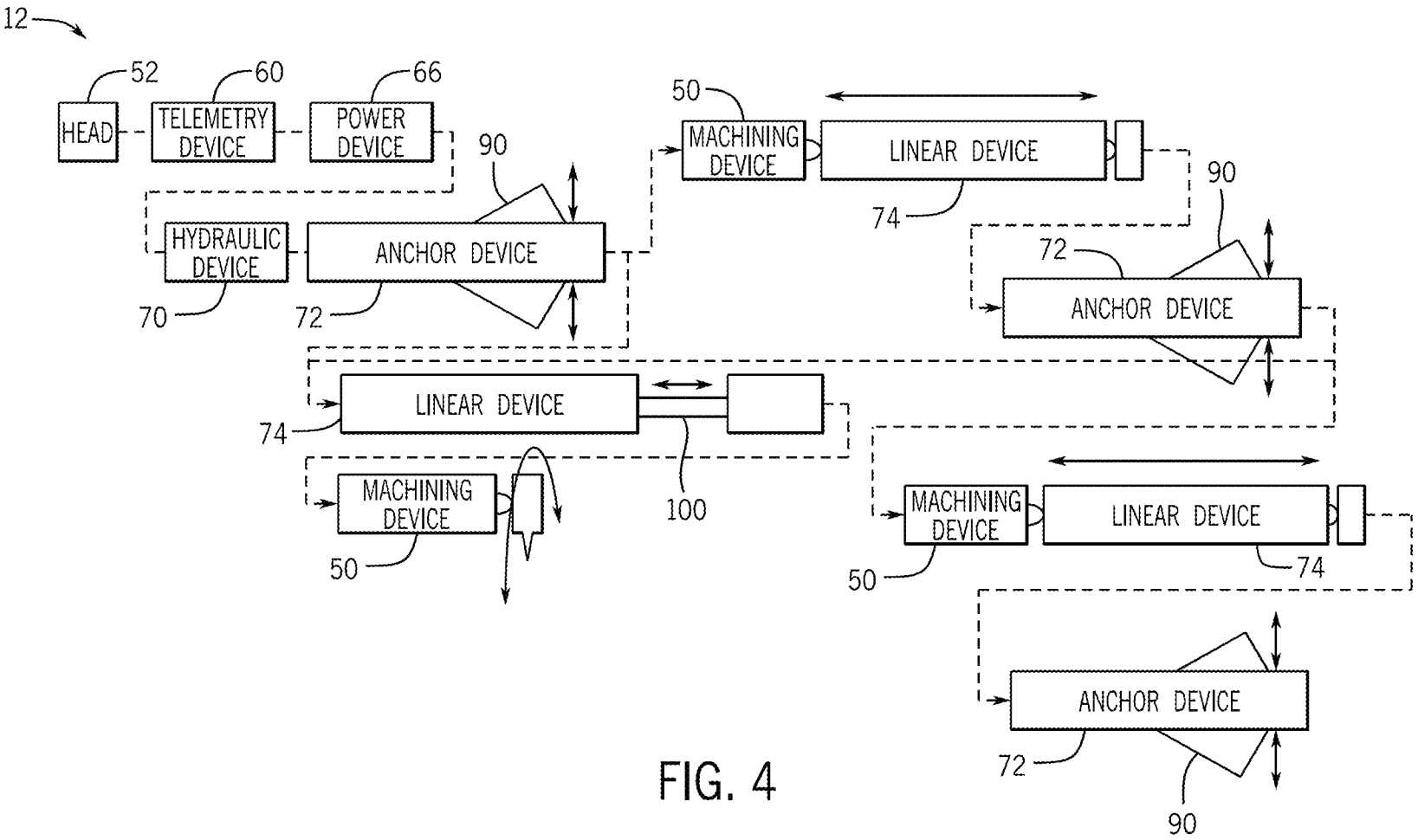
FIG. 4 is a block diagram of an embodiment of a downhole tool that may be used in a wireline system, in accordance with an embodiment of the present disclosure.

FIG. 4 is a block diagram of another embodiment of the downhole tool 12. In the illustrated embodiment, the downhole tool 12 includes a plurality of linear actuators 74, a plurality of anchors 72, and a plurality of cutting heads 50. Indeed, as set forth above, it should be appreciated that the downhole tool 12 may include any one or combination of the components discussed above, which may collectively form the downhole tool 12.

Figure 5:
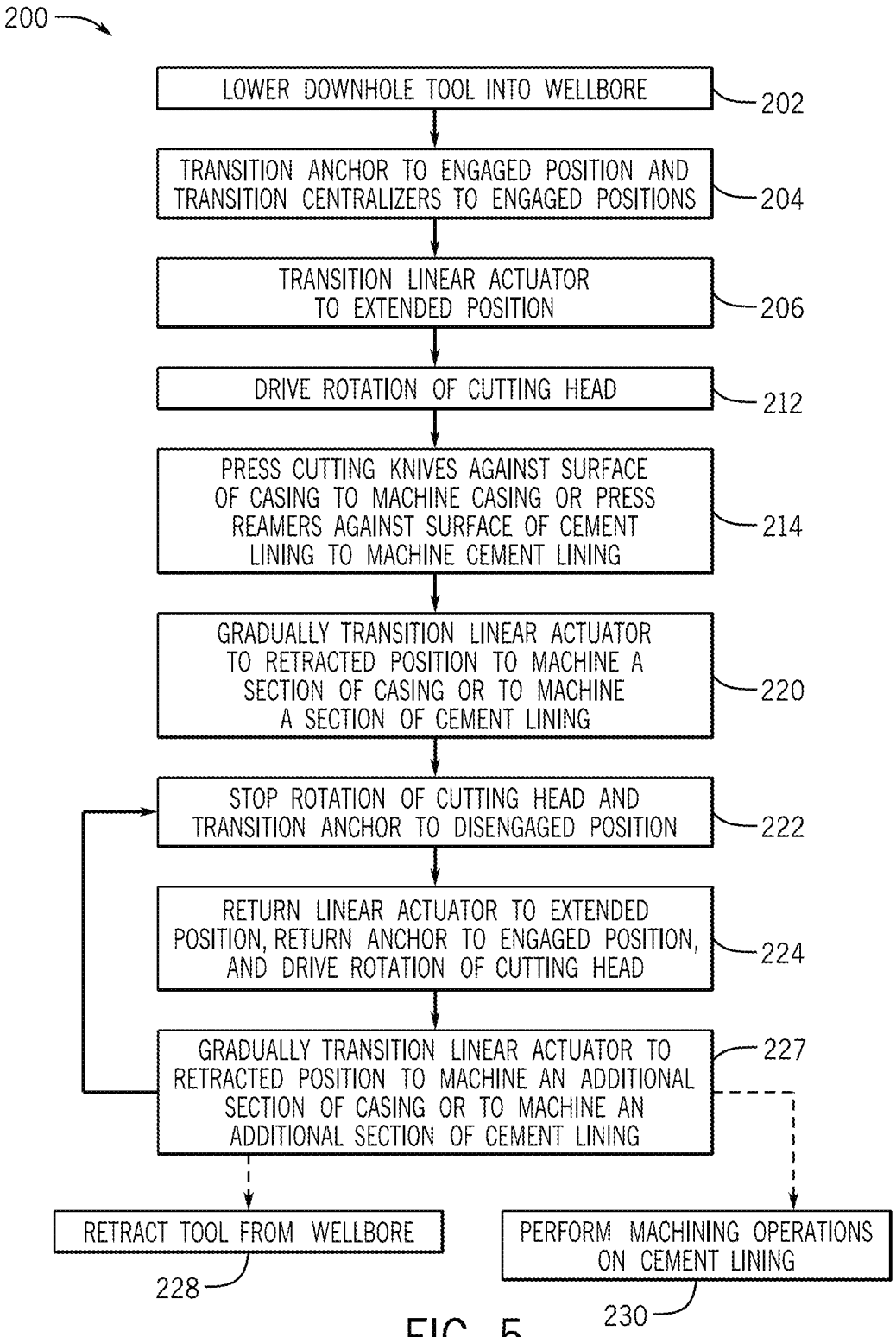
FIG. 5 is a flow diagram of an embodiment of a process for operating a downhole tool of a wireline system, in accordance with an embodiment of the present disclosure.

To facilitate discussion of the machining operations that may be performed by embodiments of the downhole tool 12 discussed herein, FIG. 5 is a flow diagram of an embodiment of process 200 of operating the downhole tool 12. The following discussion references element numbers used throughout FIGS. 1-4. It should be noted that the steps of the process 200 discussed below may be performed in any suitable order and are not limited to the order shown in the illustrated embodiment of FIG. 5. Moreover, it should be noted that additional steps of the process 200 may be performed and certain steps of the process 200 may be omitted. In some embodiments, the process 200 may be executed on the processor 30 and/or any other suitable processor of the wireline system 10, such as a processor 199 (e.g., as shown in FIG. 2) included in the downhole tool 12. The process 200 may be stored on, for example, the memory 32 and/or any other suitable memory device of the wireline system 10, such as a memory 201 (e.g., as shown in FIG. 2) of the downhole tool 12.

The process 200 may begin with lowering the downhole tool 12 into the wellbore 16 via the cable 18, as indicated by block 202. For example, the cable 18 may be spooled or unspooled from the drum 22 to position the downhole tool 12 along a particular location in the wellbore 16. In some embodiments, a weight of the downhole tool 12 and the cable 18 may be sufficient to unspool the cable 18 from the drum 22 to lower the downhole tool 12 into the wellbore 16. However, in certain embodiments, the downhole tool 12 and/or the pressure control equipment 38 may be equipped with a tractor tool (e.g., one or more motorized rollers) that are operable to force the downhole tool 12 and/or the cable 18 into the wellbore 16 to position the downhole tool 12 along a particular location in the wellbore 16.

The process 200 includes transitioning the anchor 72 to an engaged position, as indicated by block 204, upon positioned the downhole to at the desired location in the wellbore 16. For example, the hydraulic module 70 may receive instructions (e.g., from the processor 30) to supply pressurized hydraulic fluid to the anchor 72, and thus, enable the legs 90 of the anchor to transition from a retracted position to an extended position, in which the legs 90 engage (e.g., contact) the casing 17, the cement lining 19, or another suitable portion of the wellbore 16. In this manner, the anchor 72 may block rotational motion and/or translation movement of components of the upper body 104 of the downhole tool 12. The block 204 also includes transitioning the centralizers 76 to respective engaged positions, such that the centralizers 76 may center the lower body 106 of the downhole tool 12 within the casing 17.

Concurrently or subsequently to instructing the anchor 72 and the centralizers to transition to respective engaged positions, the processor 30 may instruct the linear actuator 74 to transition to an extended position, as indicated by block 206. For example, in some embodiments, the linear actuator 74 may be in a retracted positioned while the downhole tool 12 is lowered into the wellbore 16, during the block 202. Accordingly, by transitioning to the extended position at the block 206, the linear actuator 74 may space apart the lower body 106 of the downhole tool 12 from the upper body 104 of the downhole tool 12 by a distance 208 (e.g., as shown in FIG. 3). That is, the linear actuator 74 may force the lower body 106 in a first direction 210 (e.g., as shown in FIG. 3) along the wellbore 16, relative to the upper body 104, while the upper body 104 may remain stationary relative to the wellbore 16 (e.g., via a force applied by the anchor 72 to the casing 17). However, in other embodiments, the linear actuator 74 may be positioned in the extended position while the downhole tool 12 is lowered into the wellbore 16.

Next, the process 200 includes driving rotation of the cutting head 50 about the central axis 53, relative to the wellbore 16, as indicated by block 212. Particularly, the processor 30 may instruct the hydraulic module 70 to provide a flow of pressurized hydraulic fluid to the motor 122, such that the motor 122, via engagement of the gearbox 124, may drive rotation of the cutting head 50. As discussed below, the processor 30 may adjust a rotational speed of the cutting head 50 based on known characteristics of the wellbore 16 (e.g., based on a casing material used, based on a composition of the cement lining 19) or based on sensor feedback acquired by various sensors of the downhole tool 12.

The process 200 includes pressing the knives 130 of the cutting head 50 against a surface (e.g., an interior surface) of the casing 17 to initiate machining of the casing 17, as indicated by block 214. Indeed, the cutting head 50 may include one or more actuators (e.g., hydraulic actuators) that are operable to transition the knives 130 from a retracted position, in which the knives 130 do not engage the casing 17, to an extended position, in which the knives 130 engage (e.g., physically contact) the casing 17. Accordingly, when engaging with the casing 17, the rotational motion of the knives 130 about the central axis 53 may enable the knives 130 to machine (e.g., cut, scrape, chip) the casing 17 to remove material from the casing 17. In some embodiments, the cutting head 50 may continue to press the knives 130 against the casing 17 until the knives 130 machine through a thickness (e.g., a width) of the casing 17. Therefore, the knives 130 may form a circumferential slot within the casing 17.

In some embodiments, processor 30 may instruct the cutting head 50 to maintain a position of the knives 130 (e.g., a radial position of the knives 130 relative to the central axis 53) upon determining that the knives 130 have machined through the thickness of the casing 17. In some embodiments, the processor 30 may determine when the knives 130 have fully cut through the casing 17 based on feedback from one or more sensors monitoring a force applied by the knives 130 to the casing 17. For example, a force applied by the knives 130 to the casing 17 may spike (e.g., suddenly increase or decrease) when the knives 130 cut through the casing 17 and interact with the cement lining 19 and/or the geological formation 14 surrounding the casing 17. In other embodiments, the processor 30 may determine that the knives 130 have penetrated through the casing 17 based on any other one or combination of operational parameters of the wireline system 10.

In some embodiments, the downhole tool 12 may include a material collection bin 216 (e.g., as shown in FIG. 2) that is positioned beneath (e.g., with respect to a direction of gravity) the knives 130. The material collection bin 216 may collect material (e.g., shavings) that is removed from the casing 17 by the knives 130. Accordingly, the removed material may be retrieved from the wellbore 16 by retracting the downhole tool 12 from the wellbore 16. In other embodiments, the material collection bin 216 may be omitted from the downhole tool 12, such that material removed from the casing 17 may fall into the wellbore 16.

The process 200 includes gradually transitioning the linear actuator 74 from the extended position to the retracted position, as indicated by block 220. In this manner, as the linear actuator 74 retracts (e.g., as the piston 100 retracts into the body 102), the knives 130 may travel along the casing 17 to remove additional material from the casing 17. Particularly, the knives 130 may elongate (e.g., increase an axial width of) the circumferential slot that may be created by the knives 130 at the block 214. In this manner, the linear actuator 74 and the knives 130 may cooperate to form an elongated cutout 215 (e.g., as shown in FIG. 3) in the casing 17, in which a portion of the casing 17 is removed. Indeed, an axial length of the elongated cutout 215 may be substantially equal to the distance 208 upon completion of the block 220.

It should be appreciated that, in some embodiments, the knives 130 may not cut through the entire thickness of the casing 17 at the block 214, and instead, cut through only a portion of the thickness. Accordingly, the knives 130 may cut a groove into the casing 17 at the block 214, instead of a slot. Therefore, when retracting the linear actuator 74 at the block 220, the knives 130 may form an elongated groove that extends along the casing 17, instead of the elongated cutout 215.

In some embodiments, upon determining that the linear actuator 74 reaches the retracted position (e.g., in which the distance 208 is substantially negligible), the processor 30 may stop rotation of the cutting head 50, as indicated by block 222. Additionally, at the block 222, the processor 30 may instruct the anchor 72 to transition to the disengaged position, such that the legs 90 are retracted from the casing 17. It is important to note that the knives 130 remain extended, and therefore engaged with the cement lining 19, at the block 222, thereby enabling the knives 130 to temporarily support a weight of the downhole tool 12 and the cable 18. That is, the engagement between the stationary knives 130 and the cement lining 19 may ensure that the downhole tool 12 does not slide down the wellbore 16 (e.g., relative to a direction of gravity) in the first direction 210 upon retraction of the anchor 72. In some embodiments, at the block 222, the processor 30 may temporarily increase a compressive force applied by the knives 130 to the cement lining 19 to enhance an engagement strength (e.g., a frictional force) between the knives 130 and the cement lining 19. In certain embodiments, the lower body 106 may include an additional anchor that is operable to temporarily support a weight of the downhole tool 12 and/or the cable 18 in addition to, or in lieu of, the knives 130, while the anchor 72 is retracted.

At the block 224, the processor 30 may instruct the linear actuator 74 to return to the extended position. In this manner, the linear actuator 74 may force the upper body 104 of the downhole tool 12 in a second direction 226 (e.g., an upward direction relative to gravity, as shown in FIG. 3) by the distance 208, relative to the lower body 106. In some embodiments, at the block 224, the drum 22 may spool the cable 18 by a length that is equivalent to the distance 208, which may facilitate translating the upper body 104 in the second direction 226. Indeed, in some embodiments, the cable 18 may be used to provide a portion of or substantially all of the force that may be involved to move the upper body 104 in the second direction 226 by the distance 208.

In any case, upon determining that the linear actuator 74 has returned to the extended position, the processor 30 may instruct the anchor 72 to transition to the engaged position, as indicated by the block 224, to block rotational motion and translational movement of the upper body 104 relative to the wellbore 16. Additionally, at the block 224, the processor 30 may instruct the motor 122 to restart operation of the cutting head 50 (e.g., to drive rotation of the cutting head 50). The processor 30 may again instruct the linear actuator 74 to gradually transition from the extended position to the retracted position, as indicated by block 227, to enable the knives 130 to travel along the casing 17 (e.g., in the second direction 226) to remove additional material from the casing 17. That is, the knives 130 may continue to elongate (e.g., increase in axial width) the elongated cutout 215 within the casing 17.

In some embodiments, the processor 30 may iteratively repeat the blocks 222, 224, and 227 to increase an axial length of the elongated cutout 215 that may be machined by the knives 130. In certain embodiments, the processor 30 may implement the steps of the process 200 disclosed herein to form multiple slots and/or grooves within various sections of the casing 17. For example, the controller 20 may repeat the blocks 202, 204, 206, 212, 214, 220, 222, 224, and/or 227 at various locations along the casing 17 to generate multiple individual circumferential grooves and/or circumferential slots within the casing 17. In some embodiments, upon completing the desired machining operations on the casing 17, the downhole tool 12 may be retracted from the wellbore 16, as indicated by block 228.

In certain embodiments, the process 200 may include performing additional machining operations on the cement lining 19 that may surround the casing 17, as indicated by block 230. For example, in some embodiments, the downhole tool 12 may be retracted from the wellbore 16 (e.g., at the block 228 to enable a wireline operator or other technician to replace the knives 130 with reamers 232 (e.g., cement reamers, cutters, as shown in FIG. 3) that may be tailored to more effectively machine the cement lining 19 than the knives 130. Indeed, it should be appreciated that the knives 130 may include characteristics (e.g., cutting profiles, knife blade thicknesses, knife material compositions) that enable the knives 130 to efficiently machine a metallic material, such as the casing 17, while the reamers 232 include characteristics (e.g., cutting profiles, reamer blade thicknesses, reamer material compositions) that are tailored to enable efficient cutting of cement materials. However, it should be noted that, in certain embodiments, the knives 130 may be used to perform machining operations on both the casing 17 and the cement lining 19. Moreover, in some embodiments, the first cutting head 182 of the downhole tool 12 may include the knives 130 and the second cutting head 184 of the downhole tool 12 may include the reamers 232. Accordingly, the downhole tool 12 may selectively operate the first cutting head 182 or the second cutting head 184 depending on whether the downhole tool 12 is instructed to perform machining operations on the casing 17 or the cement lining 19.

In any case, the processor 30 may perform the blocks 202, 204, 206, 212, 214, 220, 222, 224, and/or 227 on the cement lining 19, instead of the casing 17, to gradually remove material from the cement lining 19 and to machine slots and/or grooves within the cement lining 19. For example, to perform machining operations on the cement lining 19, the processor 30 may lower (e.g., via instruction sent to a motor of the drum 22) the downhole tool 12 into the wellbore 16 via the cable 18, as indicated by the block 202. In some embodiments, the processor 30 may position the downhole tool 12 such that, when the linear actuator 74 is in the extended position, the reamers 232 are aligned with an initiating end 233 (e.g., as shown in FIG. 3) of the elongated cutout 215. The processor 30 may transition the anchor 72 to the engaged position, as indicated by the block 204, to maintain the downhole tool 12 at such a location in the wellbore 16.

Concurrently or subsequently to instructing the anchor 72 to transition to the engaged position, the processor 30 may instruct the linear actuator 74 to transition to the extended position and may transition the centralizers 76 to their respective extended positions, as indicated by the block 206. In some embodiments, one or more of the centralizers 76 may extend through the previously machined elongated cutout 215, such that the centralizers 76 may engage (e.g., physically contact) a portion of the cement lining 19. The processor 30 may drive rotation of the cutting head 50 (e.g., via instructions sent to the motor 122), as indicated by the block 214, and may instruct the cutting head 50 to press the reamers 232 against a surface of the cement lining 19, as indicated by the block 214. Accordingly, when engaging with the cement lining 19, rotation of the cutting head 50 may enable the reamers 232 to machine (e.g., cut, scrape, chip) the cement lining 19 to remove material from the cement lining 19. In some embodiments, the cutting head 50 may continue to press the reamers 232 against the cement lining 19 until the reamers 232 machine through the cement lining 19 and engage with the geological formation 14. Therefore, the reamers 232 may form a circumferential slot within the cement lining 19.

In some embodiments, processor 30 may instruct the cutting head 50 to maintain a position of the reamers 232 (e.g., a radial position of the reamers 232 relative to the central axis 53) upon determining that the reamers 232 have machined through the thickness of the cement lining 19. The processor 30 may determine when the reamers 232 have fully cut through the cement lining 19 in accordance with the techniques discussed above with respect to the machining operations that may be performed on the casing 17.

Next, the processor 30 may instruct the linear actuator 74 to gradually transition from the extended position to the retracted position, as indicated by the block 220, thereby enabling the reamers 232 to from an elongated cutout in the cement lining 19. For clarity, the elongated cutout may be indicative of a section of the cement lining 19 that has been removed, thereby exposing the geological formation 14 to the downhole tool 12. Upon determining that the linear actuator 74 reaches the retracted position (e.g., in which the distance 208 is substantially negligible), the processor 30 may stop rotation of the cutting head 50, as indicated by the block 222. Additionally, at the block 222, the processor 30 may instruct the anchor 72 to transition to the disengaged position, such that the legs 90 are retracted from the casing 17. The reamers 232 remain extended, and therefore engaged with the geological formation 14, at the block 222, thereby enabling the reamers 232 temporarily support a weight of the downhole tool 12 and the cable 18.

At the block 224, the processor 30 may instruct the linear actuator 74 to return to the extended position to force the upper body 104 in the second direction 226. Upon determining that the linear actuator 74 has returned to the extended position, the processor 30 may instruct the anchor 72 to transition to the engaged position, as indicated by the block 224, and may instruct the motor 122 to restart operation of the cutting head 50, as indicated by the block 224. The processor 30 may subsequently instruct the linear actuator 74 to gradually transition from the extended position to the retracted position, as indicated by the block 227, to enable the reamers 232 to travel along the cement lining 19 to remove additional material from the cement lining 19. That is, the reamers 232 may continue to elongate (e.g., increase an axial width of) the elongated cutout formed within the cement lining 19. The processor 30 may iteratively repeat the blocks 222, 224, and 227 to increase a length of elongated cutout and/or to form additional elongated cutouts within the cement lining 19.

The following discussion continues with reference to FIG. 3. In some embodiments, the first cutting head 182 may be operable to rotate respective knives 130 and/or reamers 232 in a first rotational direction 240 about the central axis 53, relative to the casing 17, while the second cutting head 184 may be operable to rotate respective knives 130 and/or reamers 232 in a second rotational direction 242 about the central axis 53, relative to the casing 17, which may be opposite to the first rotational direction 240. Accordingly, a first reaction torque imparted by the first cutting head 182 onto the downhole tool 12 may be negated by a second reaction torque (e.g., a reaction torque in a direction opposite to the first reaction torque) imparted by the second cutting head 184 onto the downhole tool 12. In this manner, utilizing a pair of counter-rotating cutting heads 182, 184 on the downhole tool 12 may reduce or substantially eliminate a resultant torque that is applied onto the anchor 72 during operation of the cutting heads 182, 184.

As briefly discussed above, the downhole tool 12 may be equipped with one or more sensors 250 that may be communicatively coupled to, for example, the processor 30 (e.g., and/or the processor 199), and that provide the processor 30 (e.g., and/or the processor 199) with feedback indicative of one or more operational parameters of the downhole tool 12. In some embodiments, the sensor feedback may enable the processor 30 (e.g., and/or the processor 199) to execute some or all of the steps of the process 200, thereby enabling automated operation of the wireline system 10.

For example, the one or more sensors 250 may include torque sensors 252 that provide the processor 30 with feedback indicative of a torque applied by the motor 122 to the first cutting head 182, a torque applied by the motor 186 to the second cutting head 184, or both. In some embodiments, the processor 30 may adjust operation of the motor 122 and/or the motor 186 if feedback from the torque sensors 252 indicates that a torque applied by the motor 122 and/or a torque applied by the motor 186 deviates from a respective target value by a threshold amount (e.g., by a predetermined percentage of the target value). For example, the processor 30 may send instructions to the hydraulic module 70 to adjust a flow rate of hydraulic fluid supplied to the motor 122 and the motor 186 upon a determination that a torque applied by the motor 122 and/or a torque applied by the motor 186 deviates from the respective target value by the threshold amount. Accordingly, the processor 30 may ensure that the motors 122 and/or 186 operate at a desired torque range during operation of the downhole tool 12.

In some embodiments, the one or more sensors 250 may include speed sensors 254 (e.g., revolution per minute sensors) that provide the processor 30 with feedback indicative of respective rotational speeds of the motor 122, the first cutting head 182, the motor 186, the second cutting head 184, or any combination thereof. In some embodiments, the processor 30 may adjust operation of the motor 122 and/or the motor 186 if feedback from the speed sensors 254 indicates that a rotational speed of the motor 122, the first cutting head 182, the motor 186, and/or the second cutting head 184 deviates from a respective target value by a threshold amount. For example, the processor 30 may send instructions to the hydraulic module 70 to adjust a flow rate of hydraulic fluid supplied to the motor 122 and/or the motor 186 upon a determination that the rotational speed of the motor 122, the first cutting head 182, the motor 186, and/or the second cutting head 184 deviates from the respective target value by the threshold amount.

In some embodiments, the one or more sensors 250 may include force sensors 256 that provide the processor 30 with feedback indicative of a force applied by the linear actuator 74 and/or displacement sensors 258 that provide the processor 30 with feedback indicative of a displacement of the linear actuator 74 (e.g. an extension distance of the piston 100 relative to the body 102). Additionally or alternatively, the one or more sensors 250 may include force sensors 260 that provide the processor 30 with feedback indicative of a force applied by the anchor 72 (e.g., a compressive force applied to the casing 17) and/or displacement sensors 262 that provide the processor 30 with feedback indicative of a position of the legs 90 (e.g., feedback indicative of whether the legs 90 are in the extended or retracted positions). In certain embodiments, the one or more sensors 250 may include acceleration sensors 264 that provide the processor 30 with feedback indicative of an acceleration of the downhole tool 12. The one or more sensor 250 may include vibration sensors 266 that provide the processor 30 with feedback indicative of vibrations across various components or sections of the downhole tool 12. Further, the one or more sensor 250 may include tensile sensors 268 that provide the processor 30 with feedback indicative of a tension on the cable 18.

In some embodiments, the one or more sensors 250 may include force sensors 270 that provide the processor 30 with feedback indicative of a force applied by the knives 130 and/or the reamers 232 against the casing 17 and the cement lining 19, respectively. Additionally or alternatively, the one or more sensors 250 may include displacement sensors 272 that provide the processor 30 with feedback indicative of an extension distance of the knives 130 and/or the reamers 232 relative to a body of the cutting head 50 (e.g., a radial dimension relative to the central axis 53).

In some embodiments, the one or more sensors 250 may acquire and provide the processor 30 with feedback indicative of any one or combination of the aforementioned operational parameters in real-time, thereby enabling the processor 30 to adjust operating parameters of the downhole tool 12 upon a determination that a particular one or the monitored operational parameters deviates from a desired target value by a threshold amount. In some embodiments, processor 30 may iteratively execute the process 200 based at least on the acquired sensor feedback from the one or more sensors 250 to automatically machine portions of the casing 17 and/or the cement lining 19 in accordance with techniques above.

In some embodiments, the processor 30 may detect a fault condition of the downhole tool 12 (e.g., a loss of electrical power provided via the cable 18) upon receiving feedback from the one or more sensors 250 indicating that a particular operational parameter of the downhole tool 12 exceeds a threshold value. In such embodiments, upon detection of the fault condition, the processor 30 may instruct the knives 130, the reamers 232, the centralizers 76, and/or the anchor 72 to transition to respective retracted positions. Accordingly, the drum 22 may be used to retract the downhole tool 12 from the wellbore 16 upon detection of the fault, without risk of the downhole tool 12 becoming stuck in the wellbore 16 due to engagement between the knives 130, the reamers 232, the centralizers 76, and/or the anchor 72 with casing 17, the cement lining 19, and/or the geological formation 14.

Figure 6:
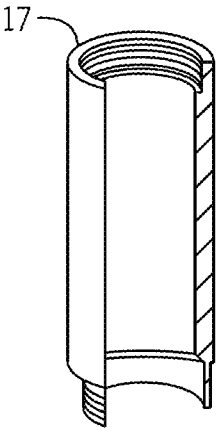
FIG. 6 is a partial cross-sectional view of an embodiment of a casing that may be deployed in a wellbore, in accordance with an embodiment of the present disclosure.
Figure 7:
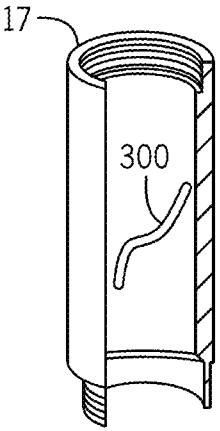
FIG. 7 is a partial cross-sectional view of an embodiment of a feature machined into a casing by a downhole tool, in accordance with an embodiment of the present disclosure.
Figure 8:
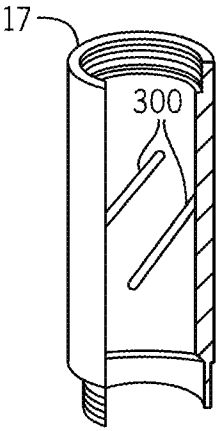
FIG. 8 is a partial cross-sectional view of an embodiment of a feature machined into a casing by a downhole tool, in accordance with an embodiment of the present disclosure.
Figure 9:
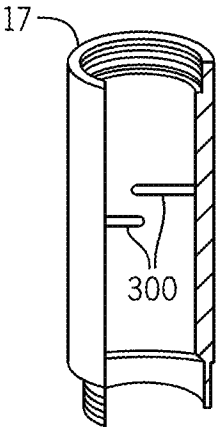
FIG. 9 is a partial cross-sectional view of an embodiment of a feature machined into a casing by a downhole tool, in accordance with an embodiment of the present disclosure.
Figure 10:
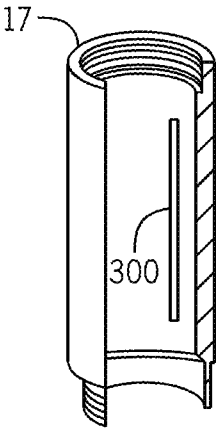
FIG. 10 is a partial cross-sectional view of an embodiment of a feature machined into a casing by a downhole tool, in accordance with an embodiment of the present disclosure.
Figure 11:
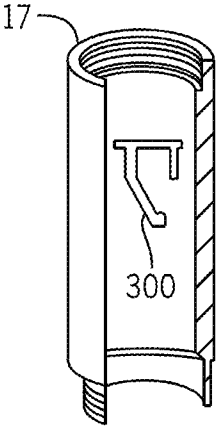
FIG. 11 is a partial cross-sectional view of an embodiment of a feature machined into a casing by a downhole tool, in accordance with an embodiment of the present disclosure.
Figure 12:
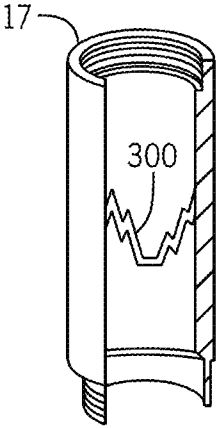
FIG. 12 is a partial cross-sectional view of an embodiment of a feature machined into a casing by a downhole tool, in accordance with an embodiment of the present disclosure.
Figure 13:
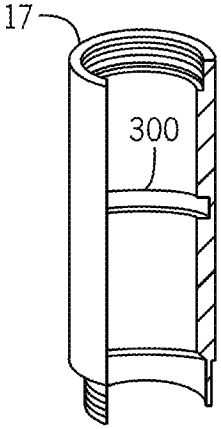
FIG. 13 is a partial cross-sectional view of an embodiment of a feature machined into a casing by a downhole tool, in accordance with an embodiment of the present disclosure.
Figure 14:
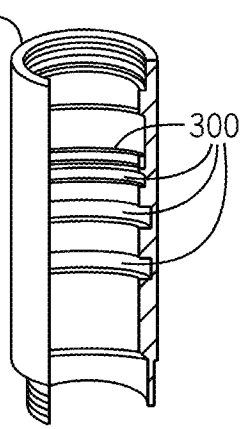
FIG. 14 is a partial cross-sectional view of an embodiment of a feature machined into a casing by a downhole tool, in accordance with an embodiment of the present disclosure.

FIG. 6 is a cross-sectional view of an embodiment of the casing 17 that may be deployed in the wellbore 16. FIGS. 7-14 are cross-sectional views of various embodiments of the casing 17 including different profiles of slots 300, which may be machined into the casing via the downhole tool 12 of the present disclosure. That is, the processor 30 and/or the processor 199 may control operation of the downhole tool 12 to machine the slots 300 into the casing 17 (e.g., via suitable tools such as a drill, mill, reamer, or other cutter).

Figure 15:
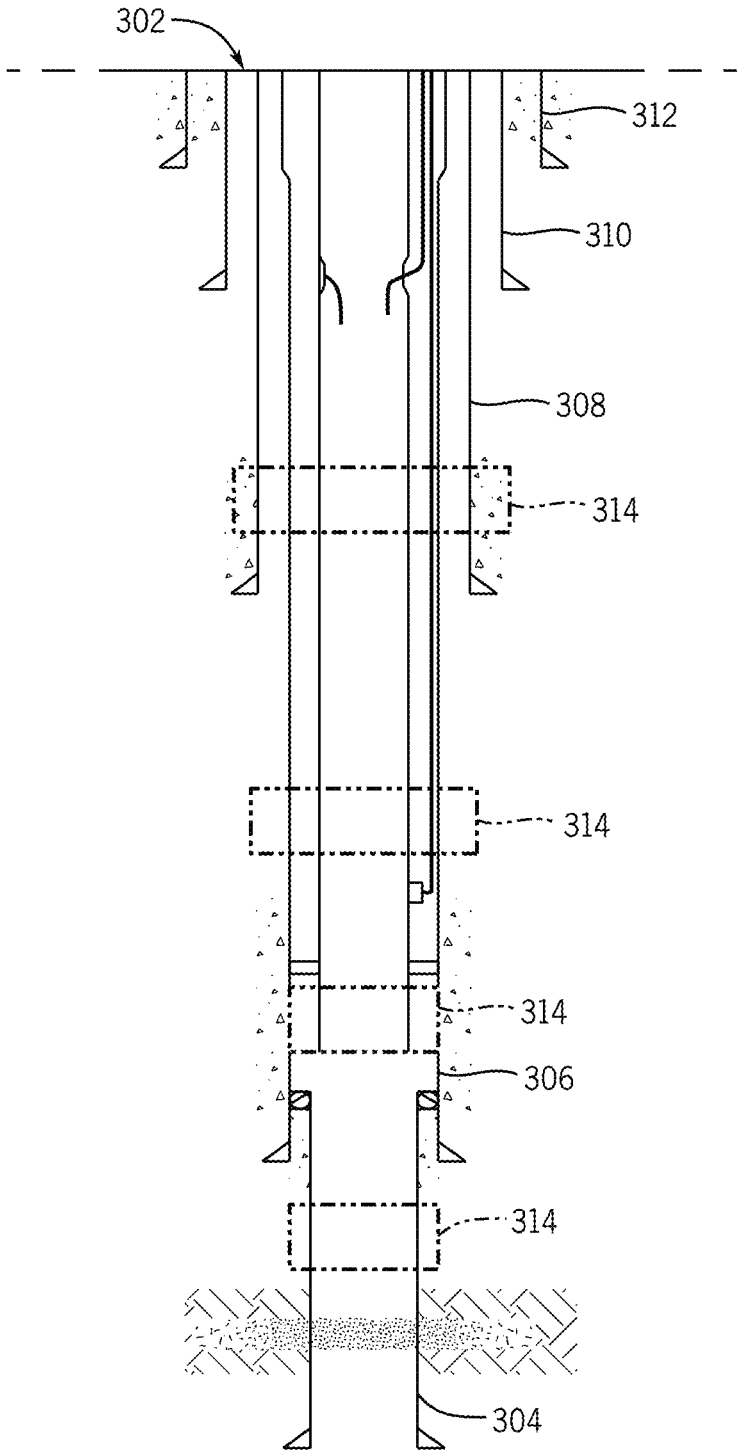
FIG. 15 is schematic diagram of an embodiment of a wellbore that includes multiple casings disposed therein, in accordance with an embodiment of the present disclosure.

FIG. 15 is a schematic diagram of a wellbore 302 (e.g., the wellbore 16) that includes a multiple layers of casing disposed therein. Particularly, the illustrated embodiment of the wellbore 302 includes a first casing 304, a second casing 306, a third casing 308, a fourth casing 310, and a fifth casing 312 disposed within one another. The downhole tool 12 of the present disclosure may be used to cut one or more slots 314 at various locations along the casings 304, 306, 308, 310, and/or 312. Accordingly, well plugs may be placed into one or more of the slots 314 to plug the wellbore 302 during a plug and abandonment operation.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A downhole tool comprising:

an anchor coupled to a first portion of the downhole tool and configured to engage with a feature of a wellbore to affix the first portion to the feature;

a first cutting head rotatable about a central axis of the downhole tool, the first cutting head coupled to a second portion of the downhole tool, the first cutting head including a plurality of actuators and a plurality of first cutters, the plurality of first cutters configured to engage with the feature in an extended position, wherein the plurality of first cutters includes at least two cutting knives or at least two reamers, wherein the at least two cutting knives or the at least two reamers include profile cutting characteristics; and a second cutting head rotatable about a central axis of the downhole tool, the second cutting head coupled to the second portion of the downhole tool, the second cutting head including a plurality of actuators and a plurality of second cutters, the plurality of second cutters configured to engage with the feature in an extended position, wherein the plurality of second cutters-includes at least two cutting knives or at least two reamers, wherein the at least two cutting knives or the at least two reamers include profile cutting characteristics;

a linear actuator coupled between the first cutting head and the second cutting head, wherein the linear actuator is configured to move the second cutting head relative to the first cutting head in a linear direction along the wellbore, thereby changing a distance between the first cutting head and the second cutting head;

a control system configured to obtain remote commands to control the anchor, the linear actuator, the first cutting head, the second cutting head, or a combination thereof.

2. The downhole tool of claim 1, comprising a plurality of sensors configured to provide the control system with feedback indicative of operational parameters of the downhole tool in real-time.

3. The downhole tool of claim 2, wherein the control system is configured to adjust operation of the anchor, the linear actuator, the first cutting head, the second cutting head, or a combination thereof, based on the feedback provided via the plurality of sensors.

4. The downhole tool of claim 3, wherein the plurality of sensors comprises at least two of:

a torque sensor configured to monitor a torque applied to the first cutting head or the second cutting head via a motor of the downhole tool;

a speed sensor configured to monitor an operational speed of the motor;

a force sensor configured to monitor a force generated by the linear actuator;

a displacement sensor configured to monitor an extension length of a piston of the linear actuator; and a displacement sensor configured to monitor an extension distance of the plurality of first cutters.

5. The downhole tool of claim 1, comprising a motor configured to drive rotation of the first cutting head and the second cutting head to enable the at least two cutting knives or at least two reamers of the first cutting head to remove material from the feature via a machining process to form a circumferential slot within the feature, wherein the feature is a casing positioned within the wellbore, a cement lining positioned within the wellbore, or both.

6. The downhole tool of claim 5, wherein the linear actuator is configured to translate the second portion relative to the feature to enable the at least two cutting knives or at least two reamers to remove additional material from the casing, the cement lining, or both, as the first cutting head translates along the feature.

7. The downhole tool of claim 1, wherein the linear actuator includes a piston that couples the first portion of the downhole tool to the second portion of the downhole tool, wherein the piston includes a passageway that enables communication lines to extend through the piston between the first portion and the second portion.

8. The downhole tool of claim 1, wherein a first motor of the downhole tool is configured to rotate the first cutting head in a first direction relative to the feature, and a second motor of the downhole tool is configured to rotate the second cutting head in a second direction relative to the feature that is opposite to the first direction.

9. A wireline system comprising:

a drum configured to spool or unspool a cable into a wellbore;

a downhole tool coupled to the cable;

the downhole tool coupled to a data processing system, the downhole tool comprising:

a first cutting head rotatable about a central axis of the downhole tool, the first cutting head including a plurality of first cutters configured to engage with a feature of the wellbore in an extended position, wherein the plurality of first cutters includes at least two cutting knives or at least two reamers, wherein the at least two cutting knives or the at least two reamers include profile cutting characteristics;

a second cutting head rotatable about a central axis of the downhole tool, the second cutting head including a plurality of second cutters configured to engage with the feature in an extended position, wherein the plurality of second cutters includes at least two cutting knives or at least two reamers, wherein the at least two cutting knives or the at least two reamers include profile cutting characteristics; and a linear actuator coupled between the first cutting head and the second cutting head, wherein the linear actuator is configured to move the second cutting head relative to the first cutting head in a linear direction along the wellbore, thereby changing a distance between the first cutting head and the second cutting head;

wherein the data processing system is configured to provide instructions to control the linear actuator, the first cutting head, the second cutting head, or both.

10. The wireline system of claim 9, wherein the data processing system is configured to cooperatively control the linear actuator, the first cutting head, and the second cutting head to enable the first cutting head and the second cutting head to form an elongated circumferential cutout within the feature of the wellbore.

11. The wireline system of claim 10, wherein the feature includes a casing disposed within the wellbore, a cement lining disposed about the wellbore, or both.

12. The wireline system of claim 9, wherein the downhold tool further comprises at least one centralizer configured to engage with the feature of the wellbore.

13. The wireline system of claim 9, wherein the downhole tool further comprises one or more sensors configured to provide the data processing system with real-time feedback indicative of operational parameters of the downhole tool, and wherein the data processing system is configured to provide the instructions to control the linear actuator, the first cutting head, the second cutting head, or a combination thereof, based on the real-time feedback.

14. The wireline system of claim 9, wherein the first cutting head and the second cutting head are configured to perform a machining operation on the feature to remove material from the feature, and wherein the downhole tool comprises a material collection bin configured to capture the material removed from the feature.

15. The wireline system of claim 9, wherein the data processing system is configured to detect a fault condition of the downhole tool based on feedback from one or more sensor of the downhole tool and, in response to detecting the fault condition, instruct the plurality of first cutters of the first cutting head or the plurality of second cutters of the second cutting head to transition to a retracted position.

16. A method comprising:

disposing a downhole tool within a casing of a wellbore, the downhole tool comprising a first cutting head and a second cutting head, the first cutting head having a plurality of first cutters, and the second cutting head having a plurality of second cutters;

fastening a first portion of the downhole tool to an interior surface of the casing through an anchor;

operating a linear actuator positioned between the first cutting head and the second cutting head to move the second cutting head relative to the first cutting head in a linear direction along the wellbore, thereby changing a distance between the first cutting head and the second cutting head of the downhole tool;

rotating the first cutting head and the second cutting head about a central axis of the downhole tool;

using one or more actuators to extend the plurality of first cutters of the first cutting head or the plurality of second cutters of the second cutting head into an extended position, wherein the plurality of first cutters includes at least two cutting knives or at least two reamers, wherein the at least two cutting knives or the at least two reamers include profile cutting characteristics; and forcing the plurality of first cutters into the casing to machine a non-circumferential profile into the interior surface of the casing using the plurality of first cutters.

17. The method of claim 16, comprising:

penetrating through the casing with the plurality of first cutters to form a circumferential slot within the casing; and translating the first cutting head or the second cutting head along the casing via the linear actuator to enable the plurality of first cutters to extend the circumferential slot into an elongated cutout that extends along the casing.

18. The method of claim 17, comprising:

forcing the plurality of first cutters into a cement lining positioned about the casing to machine the cement lining using the plurality of first cutters;

penetrating through the cement lining with the plurality of first cutters to form an additional circumferential slot within the cement lining; and translating the second cutting head along the cement lining via the linear actuator to enable the plurality of second cutters to extend the additional circumferential slot into an additional elongated cutout that extends along the cement lining.

* * * * *